US005899254A

United States Patent [19]

Cook

[11] Patent Number: 5,899,254

[45] Date of Patent: May 4, 1999

[54] GARAGE SCREEN

[76] Inventor: Brian S. Cook, 17433 Jerry Pl., Hayward, Calif. 94541

[21] Appl. No.: 09/048,676

[22] Filed: Mar. 26, 1998

[51] Int. Cl.[6] ..... A47G 5/02

[52] U.S. Cl. ..... 160/321; 160/322

[58] Field of Search ..... 160/319, 320, 160/321, 322, 23.1, 307, 268.1, 323.1, 903; 248/269, 270, 271, 272, 266

[56] References Cited

U.S. PATENT DOCUMENTS

| | | | |
|---|---|---|---|
| 1,134,326 | 4/1915 | Gambon | 160/322 X |
| 1,341,742 | 6/1920 | Fisher | 248/269 |
| 1,499,340 | 7/1924 | Bundy | 248/269 |
| 1,591,104 | 7/1926 | Robinson | 160/307 X |
| 1,693,457 | 11/1928 | Pagano | 160/321 |
| 1,820,503 | 8/1931 | Senior | 160/321 X |
| 2,013,500 | 9/1935 | O'Connor | 248/269 |
| 3,151,857 | 10/1964 | Falkenberg | 160/322 X |
| 4,252,172 | 2/1981 | Pommat et al. | 160/322 |
| 4,673,019 | 6/1987 | Silverthorne et al. | 160/268.1 |
| 4,846,241 | 7/1989 | Chomka et al. | 160/23.1 |

*Primary Examiner*—David M. Purol

[57] ABSTRACT

A garage screen is provided including a screen assembly having a cylinder rotatably coupled adjacent to a top edge of a sliding garage door with a spool mounted thereon. A rope is included having a first end connected to the spool and a second end for manually deploying the screen when desired.

6 Claims, 4 Drawing Sheets

GARAGE SCREEN

BACKGROUND OF THE INVENTION

1. Field of the Invention

The present invention relates to garage screens and more particularly pertains to a new garage screen for preventing insects and damaging ultraviolet rays from entering a garage while allowing air circulation with a screen when a garage door is opened.

2. Description of the Prior Art

The use of garage screens is known in the prior art. More specifically, garage screens heretofore devised and utilized are known to consist basically of familiar, expected and obvious structural configurations, notwithstanding the myriad of designs encompassed by the crowded prior art which have been developed for the fulfillment of countless objectives and requirements.

Known prior art garage screens include U.S. Pat. No. 4,673,019; U.S. Pat. No. 5,123,474; U.S. Pat. No. 4,846,241; U.S. Pat. Des. 338,966; U.S. Pat. No. 5,427,169; and U.S. Pat. No. 4,653,566.

In these respects, the garage screen according to the present invention substantially departs from the conventional concepts and designs of the prior art, and in so doing provides an apparatus primarily developed for the purpose of preventing insects and damaging ultraviolet rays from entering a garage while allowing air circulation with a screen when a garage door is opened.

SUMMARY OF THE INVENTION

In view of the foregoing disadvantages inherent in the known types of garage screens now present in the prior art, the present invention provides a new garage screen construction wherein the same can be utilized for preventing insects and damaging ultraviolet rays from entering a garage while allowing air circulation with a screen when a garage door is opened.

The general purpose of the present invention, which will be described subsequently in greater detail, is to provide a new garage screen apparatus and method which has many of the advantages of the garage screens mentioned heretofore and many novel features that result in a new garage screen which is not anticipated, rendered obvious, suggested, or even implied by any of the prior art garage screens, either alone or in any combination thereof.

To attain this, the present invention generally comprises a pair of inverted L-shaped brackets each having a vertical extent mounted adjacent to an end of a top edge of a garage door. Each bracket further has a horizontal extent extending inwardly with an aperture formed therein. See FIG. 3. FIG. 4 shows a pair of adjustable bearing assemblies each including a vertically oriented threaded post slidably situated within the aperture of an associated one of the brackets. Such posts are preferably coupled with respect to the brackets via a pair of nuts. Each bearing assembly further includes a bearing aperture coupled to a bottom end of the threaded post. The adjustable nature of each bearing assembly ensures that the bearing apertures of each bearing assembly are in alignment with a common horizontal axis. Next provided is a screen assembly including a cylinder. The cylinder has a pair of ends with rods extending therefrom in concentric relationship therewith. These rods are adapted for rotatably coupling within the bearing apertures of the bearing assemblies. As shown in FIG. 4, one of the rods extends through the corresponding bearing aperture and terminates at a spool fixedly and coaxially coupled thereto. The screen assembly further includes a flexible mesh screen having a planar rectangular configuration with a top edge connected to the cylinder. During use, the mesh screen is adapted for being selectively wrapped about the cylinder upon the rotation of the spool. As shown in FIG. 1, a bottom edge of the mesh screen is equipped with a weight mounted along a length thereof. Mounted above the spool of the screen assembly is a pulley. The rope further serves for retracting the screen upon the lowering of the garage door, or when desired.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new garage screen apparatus and method which has many of the advantages of the garage screens mentioned heretofore and many novel features that result in a new garage screen which is not anticipated, rendered obvious, suggested, or even implied by any of the prior art garage screens, either alone or in any combination thereof.

It is another object of the present invention to provide a new garage screen which may be easily and efficiently manufactured and marketed.

It is a further object of the present invention to provide a new garage screen which is of a durable and reliable construction.

An even further object of the present invention is to provide a new garage screen which is susceptible of a low cost of manufacture with regard to both materials and labor, and which accordingly is then susceptible of low prices of sale to the consuming public, thereby making such garage screen economically available to the buying public.

Still yet another object of the present invention is to provide a new garage screen which provides in the apparatuses and methods of the prior art some of the advantages thereof, while simultaneously overcoming some of the disadvantages normally associated therewith.

Still another object of the present invention is to provide a new garage screen for preventing insects and damaging ultraviolet rays from entering a garage while allowing air circulation with a screen that may be deployed when a garage door is opened.

Even still another object of the present invention is to provide a new garage screen that includes a screen assembly having a cylinder rotatably coupled adjacent to a top edge of a sliding garage door with a spool mounted thereon. A rope is included having a first end connected to the spool and a second end for manually deploying the screen when desired.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
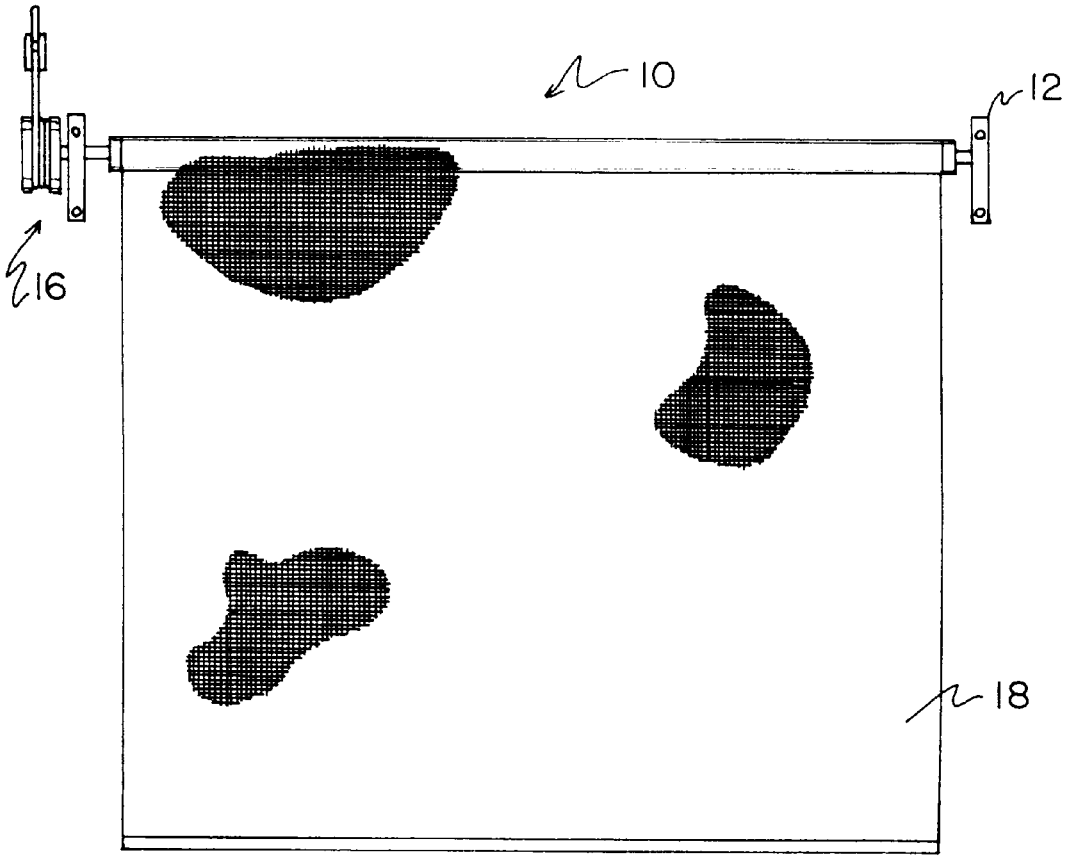
FIG. 1 is a front view of a new garage screen according to the present invention.
Figure 2:
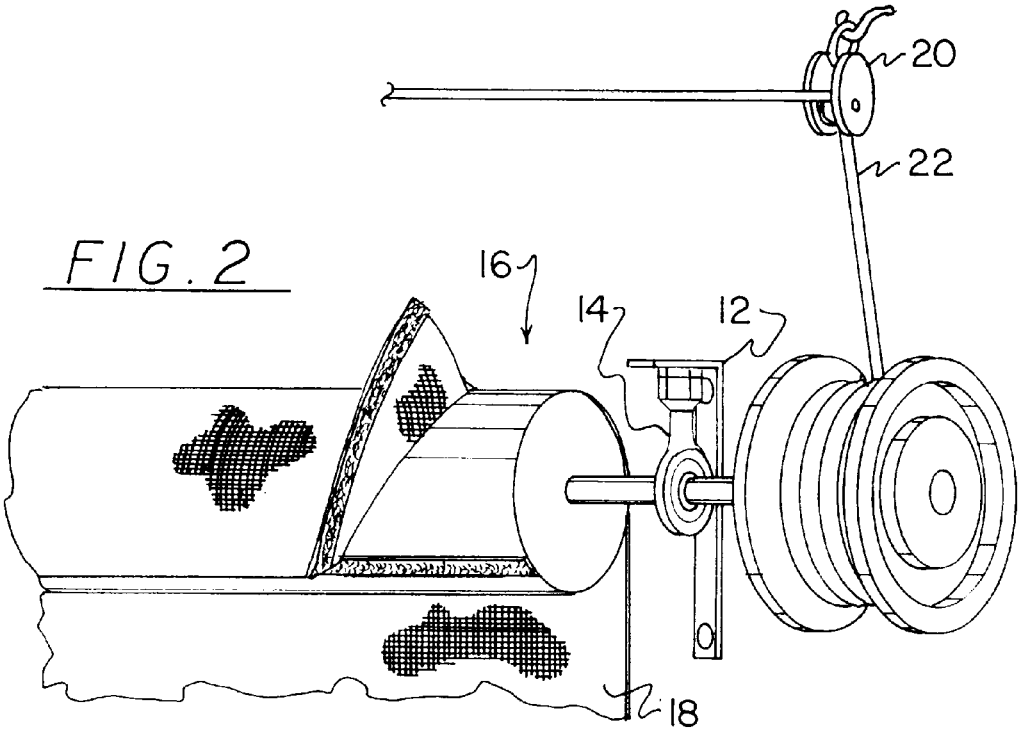
FIG. 2 is a perspective view of the present invention.
Figure 3:
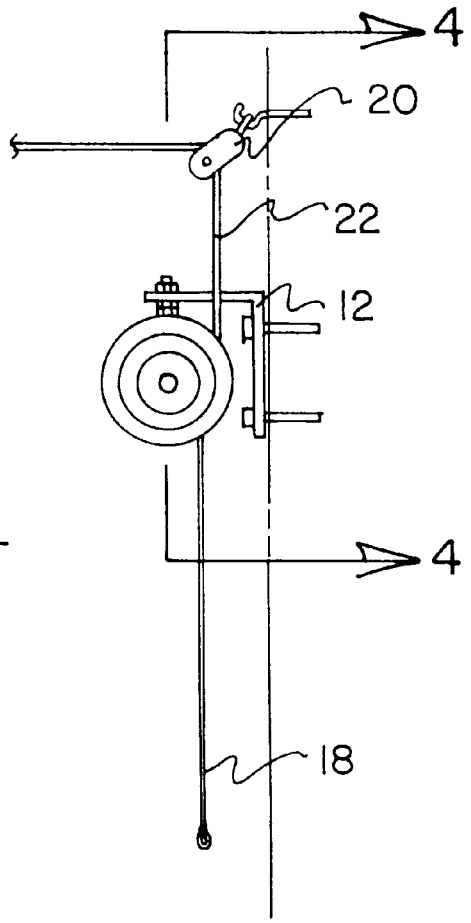
FIG. 3 is a side view of the present invention.

With reference now to the drawings, and in particular to FIGS. 1 through 7 thereof, a new garage screen embodying the principles and concepts of the present invention and generally designated by the reference numeral 10 will be described.

The present invention, designated as numeral 10, includes a pair of inverted L-shaped brackets 12 each having a vertical extent mounted to wall adjacent to an end of a top edge of a garage door. Each bracket further has a horizontal extent extending inwardly with a vertically oriented aperture formed therein. See FIG. 3.

Figure 4:
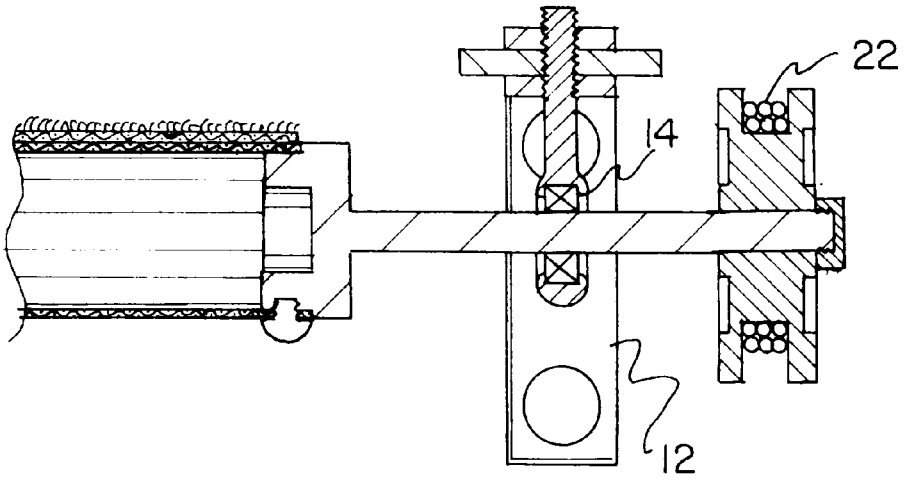
FIG. 4 is a cross-sectional of the present invention taken along line 4—4 shown in FIG. 3.
Figure 5:
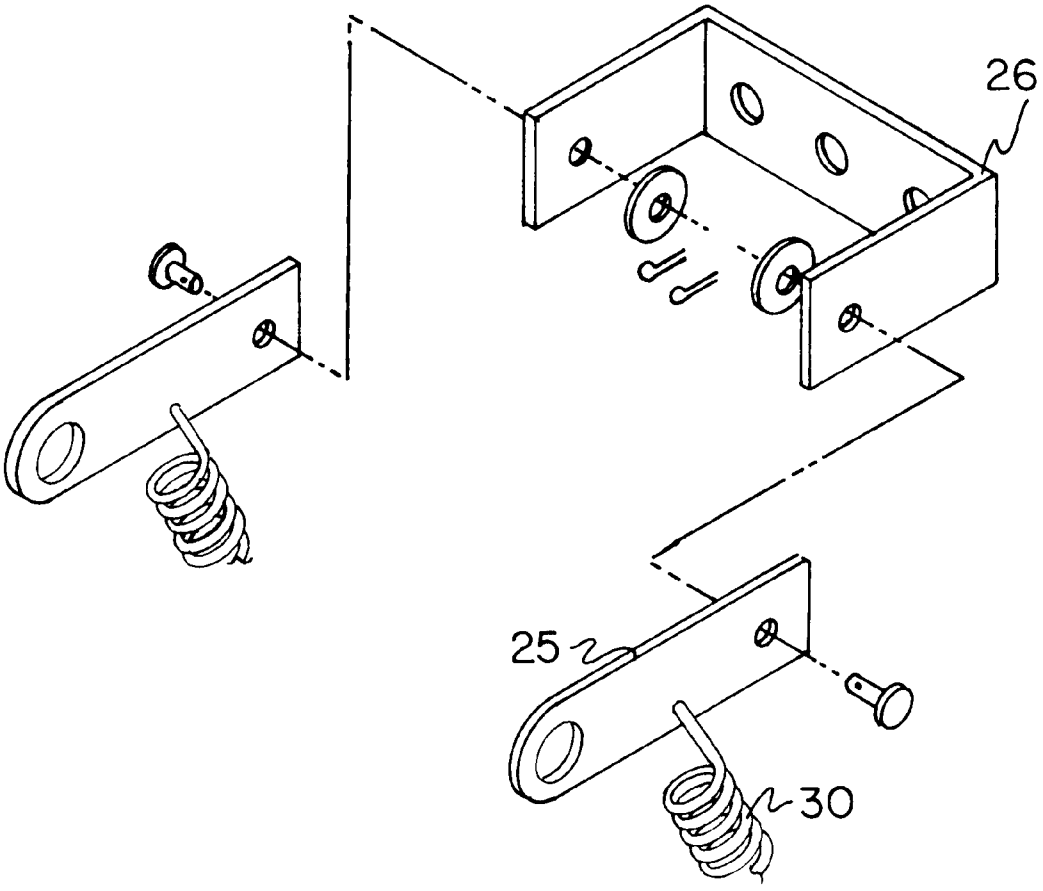
FIG. 5 is an exploded perspective view of an alternate embodiment of the present invention.
Figure 6A:
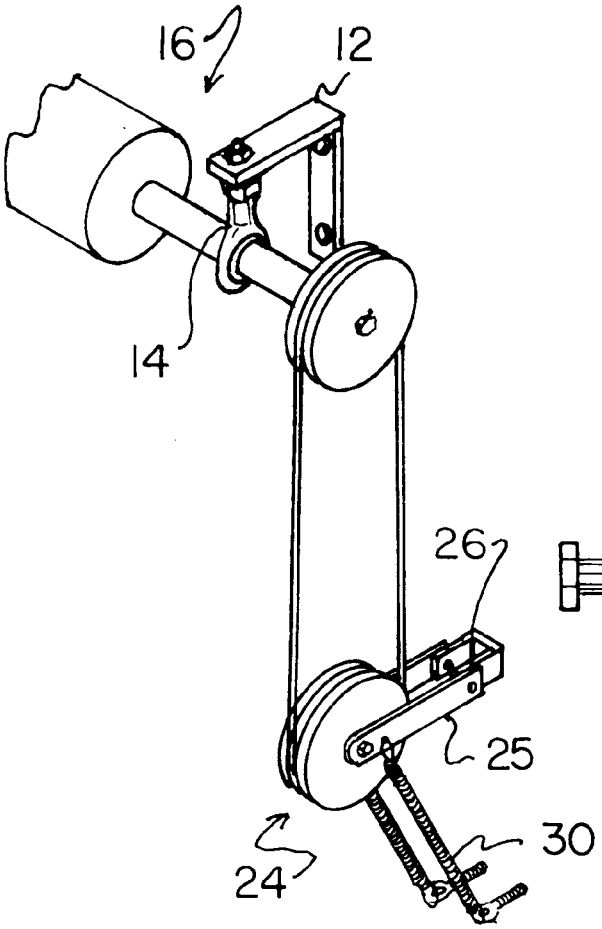
FIG. 6A is a perspective view of the embodiment of the present invention shown in FIG. 5.
Figure 6B:
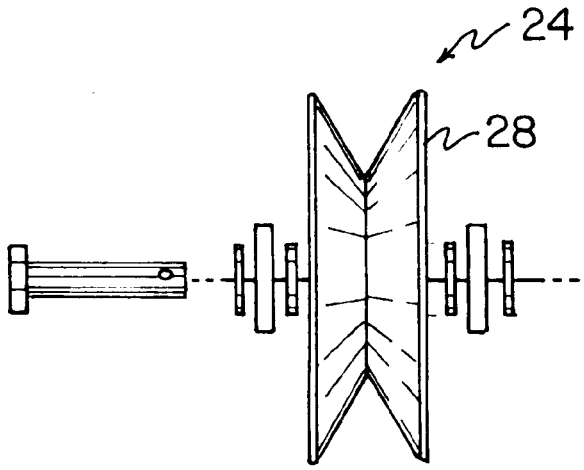
FIG. 6B is an exploded view of the auxiliary spool of the alternate embodiment of FIG. 5.

FIG. 4 shows a pair of adjustable bearing assemblies 14 each including a vertically oriented threaded post slidably situated within the aperture of an associated one of the brackets. Such posts are preferably coupled with respect to the brackets via a pair of nuts. Each bearing assembly further includes a bearing aperture coupled to a bottom end of the threaded post. Such bearing apertures preferably comprise of an eyelet situated on the bottom end of the posts with annular bearings formed therein. The adjustable nature of each bearing assembly allows the bearing apertures to be raised and lowered such that the same are in alignment with a common horizontal axis.

Next provided is a screen assembly 16 including a cylinder. The cylinder has a pair of ends with rods extending therefrom in concentric relationship therewith. These rods are adapted for rotatably coupling within the bearing apertures of the bearing assemblies. As shown in FIG. 4, one of the rods extends through the corresponding bearing aperture and terminates at a spool fixedly and coaxially coupled thereto. When properly mounted, the cylinder resides above the garage door so as to not interfere with its use.

The screen assembly further includes a flexible mesh screen 18 having a planar rectangular configuration with a top edge connected to the cylinder. Such connection is preferably accomplished by way of a pile type fastener for permitting convenient replacement of the screen when required. During use, the mesh screen is adapted for being selectively wrapped about the cylinder upon the rotation of the spool. As shown in FIG. 1, a bottom edge of the mesh screen is equipped with a weight mounted along a length thereof.

Mounted above and offset from the spool of the screen assembly is a pulley 20. A rope 22 is included having a first end connected to the spool and a free second end. In operation, the rope is slidable along the pulley for allowing a user to manually deploy the screen upon the raising of the garage door, or when desired. The rope further serves for retracting the screen when desired. Due to the weight associated with the screen, the screen is deployed by simply releasing the rope and retracted by pulling the rope and tying the same to a recipient surface. In the preferred embodiment, the screen is lowered after the door is opened and retracted before the door is closed. As an option, additional strategically located pulleys may be used to allow the selective placement of the free second end of the rope.

In an alternate embodiment, an auxiliary spool unit 24 is provided including a U-shaped connector connected adjacent to the garage door below the spool of the screen assembly. Note FIGS. 6–7. The present embodiment includes a pair of linear arms 25 having inboard ends pivotally coupled to the U-shaped connector 26 for pivoting within parallel vertical planes. An auxiliary spool 28 is rotatably coupled between second ends of the arms in coplanar relationship with spool of the screen assembly. A belt is situated between the spools. Finally, a pair of springs 30 each have a top end coupled to the second end of an associated one of the arms. A second end of each spring is connected adjacent to the garage door below the U-shaped connector for urging the arms downwardly to maintain the belt taut. This allows a user to manipulate the belt in order to rotate the spool of the screen assembly and effect the manual raising and lowering of the screen. It should be noted that the force applied to the belt by the springs precludes the screen from falling due to the associated weight.

Figure 7:
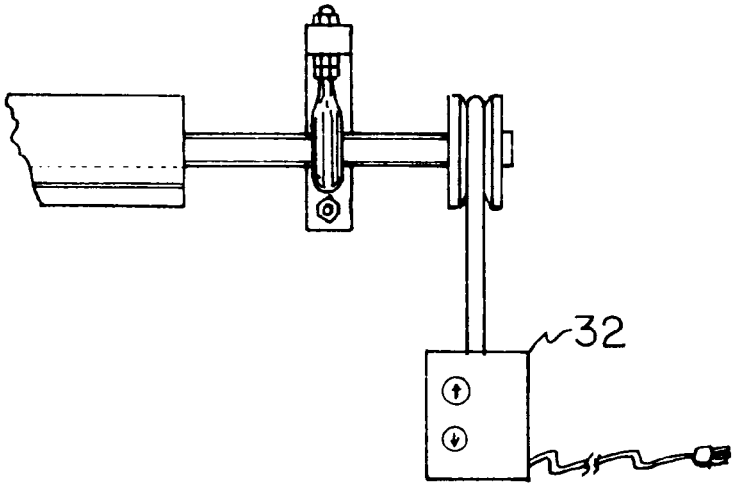
FIG. 7 is an illustration of yet another embodiment of the present invention.

In yet another alternate embodiment, as shown in FIG. 7, a reversible motor 32 is in communication with the spool of the screen assembly via a belt. Such motor operates to mechanically raise and lower the mesh screen by way of motorized action.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A garage screen comprising:

a pair of inverted L-shaped brackets each having a vertical extent mounted adjacent to an end of a top edge of a garage door and a horizontal extent extending inwardly therefrom with an aperture formed therein;

a pair of adjustable bearing assemblies each including a vertically oriented threaded post slidably situated within the aperture of an associated one of the brackets and further coupled thereto via a pair of nuts, each bearing assembly further including a bearing aperture coupled to a bottom end of the threaded post such that the bearing apertures of each bearing assembly are in alignment with a common horizontal axis;

a screen assembly including a cylinder having a pair of ends with rods extending therefrom in concentric relationship therewith for rotatably coupling within the bearing apertures of the bearing assemblies wherein one of the rods extends through the corresponding bearing aperture and terminates at a spool fixedly and coaxially coupled thereto, the screen assembly further includes a flexible mesh screen having a planar rectangular configuration with a top edge connected to the cylinder for being selectively wrapped about the cylinder upon the rotation of the spool and a bottom edge with a weight mounted along a length thereof;

a pulley mounted above the spool of the screen assembly in coplanar relationship therewith; and a rope having a first end connected to the spool and a free second end, the rope being slidable along the pulley for manually deploying and retracting the screen.

2. A garage screen comprising:

a screen assembly including a cylinder adapted for being rotatably coupled adjacent to a top edge of a sliding garage door with a spool mounted thereon and a screen removably attached to the spool by way of pile fasteners;

a rope having a first end connected to the spool and a free second end for manually deploying and retracting the screen; and a pulley mounted above the spool of the screen assembly in coplanar relationship therewith, wherein the rope is slidable along the pulley for manually deploying and retracting the screen;

wherein the screen of the screen assembly has a weight coupled to a bottom edge thereof.

3. A garage screen as set forth claim 2 wherein the cylinder of the screen assembly is rotatably coupled to a pair of vertically adjustable apertures.

4. A garage screen as set forth claim 3 wherein the apertures are bearing apertures.

5. A garage screen as set forth claim 2 wherein the cylinder is mounted adjacent to the garage door via a pair of L-shaped brackets.

6. A garage screen comprising:

a screen assembly including a cylinder adapted for being rotatably coupled adjacent to a top edge of a garage door with a spool mounted thereon; and an auxiliary spool unit including at least one arm having an inboard end adapted for being pivotally coupled to a vertical recipient surface adjacent the garage door, an auxiliary spool rotatably coupled to a second end of the arm in coplanar relationship with spool of the screen assembly for distancing the auxiliary spool from the vertical recipient surface and maintaining the same within a plane that includes the spool of the screen assembly, a belt situated between the spools, and at least one coil spring having a top end coupled to the second end of the arm and a second end adapted for being connected to the vertical recipient surface below the arm for pivoting the arm downwardly to maintain the belt taut, thereby allowing a user to manipulate the belt in order to rotate the spool of the screen assembly and effect the raising and lowering of the screen.

* * * * *